US006758916B1

(12) United States Patent
McCormick

(10) Patent No.: US 6,758,916 B1
(45) Date of Patent: Jul. 6, 2004

(54) COMPOSITION AND PROCESS FOR TREATING METALS

(75) Inventor: David R. McCormick, Clawson, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 10/111,177

(22) PCT Filed: Oct. 24, 2000

(86) PCT No.: PCT/US00/29266

§ 371 (c)(1),
(2), (4) Date: Apr. 19, 2002

(87) PCT Pub. No.: WO01/32952

PCT Pub. Date: May 10, 2001

Related U.S. Application Data

(60) Provisional application No. 60/162,455, filed on Oct. 29, 1999.

(51) Int. Cl.[7] ..... C23C 22/00

(52) U.S. Cl. ..... 148/251; 148/247; 148/259; 148/260

(58) Field of Search ..... 148/251, 247, 148/259, 260

(56) References Cited

U.S. PATENT DOCUMENTS

| | | | | |
|---|---|---|---|---|
| 4,376,000 | A | 3/1983 | Lindert | 148/6.15 |
| 4,433,015 | A | 2/1984 | Lindert | 427/388.4 |
| 4,517,028 | A | 5/1985 | Lindert | 148/6.14 |
| 5,116,912 | A | 5/1992 | Lindert et al. | 525/340 |
| 5,449,415 | A | 9/1995 | Dolan | 148/259 |
| 5,885,373 | A | 3/1999 | Sienkowski | 148/247 |
| 5,891,952 | A | 4/1999 | McCormick et al. | 524/596 |
| 5,958,511 | A | 9/1999 | Dolan | 427/258 |

*Primary Examiner*—Andrew L. Oltmans
(74) *Attorney, Agent, or Firm*—Stephen D. Harper; Mary K. Cameron

(57) ABSTRACT

A chromium free conversion coating at least equivalent in corrosion protective quality to conventional chromate conversion coatings can be formed on metals, particularly cold rolled steel, by a dry-in-place aqueous acidic liquid that preferably has a pH value between 0.5 and 5.0 and comprises: (A) "fluorometallate" anions consisting of (i) at least four fluorine atoms, (ii) at least one atom of an element selected from the group consisting of titanium, zirconium, hafnium, silicon, aluminum, and boron, and, optionally, one or more of (iii) ionizable hydrogen atoms and (iv) oxygen atoms; (B) a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A) is at least about 1:5 but not greater than about 3:1; (C) a component selected from the group consisting of phosphorus-containing inorganic oxyanions and phosphonate anions; and (D) a component of polymers of hydroxy styrene, modified by substitution on the aromatic rings of the polymers of substituted aminomethyl moieties, in which the substituents (other than the carbon atom that is directly bonded to an aromatic ring in the polymer) on the amino nitrogen atom jointly contain at least two carbon atoms and at least one hydroxy moiety but neither of these substituents on the amino nitrogen atom individually contains more than half as many hydroxyl moieties as it has carbon atoms, unless it contains only one carbon atom.

38 Claims, No Drawings

COMPOSITION AND PROCESS FOR TREATING METALS

CROSS-REFERENCE TO RELATED APPLICATIONS

This application claims priority from International Application No. PCT/US00/29266, filed Oct. 24, 2000, and published in English as WO 01/32925, and from United States Provisional Application Ser. No. 60/162,455, filed Oct. 29, 1999.

STATEMENT REGARDING FEDERALLY SPONSORED RESEARCH OR DEVELOPMENT

Not Applicable

BACKGROUND OF THE INVENTION

This invention relates to compositions and processes for treating metal surfaces with acidic aqueous compositions for forming conversion coatings on the metals; the conversion coatings provide excellent bases for subsequent painting. The invention is well suited to treating iron and steel, galvanized iron and steel, zinc and those of its alloys that contain at least 50 atomic percent zinc, and aluminum and its alloys that contain at least 50 atomic percent aluminum. Preferably the surface treated is predominantly ferrous; most preferably the surface treated is cold rolled steel.

This invention is very closely related to that disclosed in U. S. Pat. No. 5,449,415, from which it differs primarily in using a particularly advantageous type of water soluble and/or dispersible polymer. The object of this invention is to achieve better corrosion resistance under at least one set of corrosion promoting conditions than does the invention illustrated by examples in U.S. Pat. No. 5,449,415, without using any more hexavalent chromium in the process than is used in preferred examples in U.S. Pat. No. 5,449,415.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout this description unless expressly stated to the contrary: percent, "parts of", and ratio values are by weight; the term "polymer" includes oligomer, the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to an object of the invention; and the term "mole" and its variations means "gram-mole" and its variations and may be applied to elemental, ionic, hypothetical, unstable, and any other chemical species defined by number and type of atoms present, as well as to compounds with well defined molecules.

BRIEF SUMMARY OF THE INVENTION

It has been found that improved resistance to corrosion, particularly after subsequent conventional coating with an organic binder containing protective coating such as a paint or lacquer, can be imparted to active metal surfaces, particularly to iron and steel and other ferrous surfaces, by contacting the metal surfaces for a sufficient time at a sufficient temperature with an acidic aqueous composition as described in detail below. Such a composition differs from some preferred embodiments illustrated by example in U.S. Pat. No. 5,449,415 most markedly in the specific chemical nature of the substituents on the polymers of hydroxy styrene, modified by substitution on the aromatic rings of the polymers of substituted aminomethyl moieties, which are characteristic of both this invention and the preferred examples of U.S. Pat. No. 5,449,415. In the latter, at least one of the two substituents, exclusive of the single carbon atom that is bonded both to the amino nitrogen and the aromatic ring, on the amino nitrogen atom of each substituent moiety is a polyhydroxy moiety, but in the present invention both of these substituents jointly contain at least two carbon atoms and at least one hydroxy moiety but neither of these substituents on the amino nitrogen atoms individually contains more than half as many hydroxyl moieties as it has carbon atoms, unless it contains only one carbon atom. Preferably, the composition is coated over the metal surface to be treated and then dried in place on the surface of the metal, without intermediate rinsing.

Various embodiments of the Invention include working compositions for direct use in treating metals, concentrates from which such working compositions can be prepared by dilution with water, processes for treating metals with a composition according to the invention, and extended processes including additional steps that are conventional per se, such as precleaning, rinsing, and, particularly advantageously, painting or some similar overcoating process that puts into place an organic binder containing protective coating over the conversion coating formed according to a narrower embodiment of the invention. Articles of manufacture including surfaces treated according to a process of the invention are also within the scope of the invention.

DETAILED DESCRIPTION OF THE INVENTION AND PREFERRED EMBODIMENTS

An acidic aqueous composition according to the invention comprises, preferably consists essentially of, or more preferably consists of, water and:

(A) a component of "fluorometallate" anions, each of said anions consisting of (i) at least four fluorine atoms, (ii) at least one atom of an element selected from the group consisting of titanium, zirconium, hafnium, silicon, aluminum, and boron, and, optionally, one or both of (iii) ionizable hydrogen atoms, and (iv) one or more oxygen atoms; preferably the anions are fluorotitanate (i.e., $TiF_6^{-2}$) or fluorozirconate (i.e., $ZrF_6^{-2}$), most preferably fluorotitanate;

(B) a component of divalent or tetravalent cations of elements selected from the group consisting of cobalt, magnesium, manganese, zinc, nickel, tin, copper, zirconium, iron, and strontium; independently preferably at least, with increasing preference in the order given, 60, 70, 80, 85, 90, 95, or 99% by weight of the total of component (B) consisting of divalent manganese, cobalt, nickel, or magnesium, more preferably of divalent manganese, cobalt, or nickel; most preferably of divalent manganese;

(C) a component of phosphorus-containing Inorganic oxyanions and/or phosphonate anions; and (D) a component of water-soluble and/or water-dispersible polymers of vinyl phenol having at least mono-substituted aminomethyl moieties as substituents on the aromatic rings of said polymers; and, optionally, one or more of the following components:

(E) a dissolved oxidizing agent, preferably a peroxy compound, more preferably hydrogen peroxide;

(F) a component selected from the group consisting of tungstate, molybdate, silicotungstate, and silicomolybdate anions; and (G) a component selected from dissolved or dispersed complexes stabilized against settling, said complexes resulting from reaction between:

"fluorometallate" anions, each of said anions consisting of (i) at least four fluorine atoms, (ii) at least one atom of an element selected from the group consisting of titanium, zirconium, hafnium, silicon, aluminum, and boron, and, optionally, one or both of (iii) ionizable hydrogen atoms, and (iv) one or more oxygen atoms and one or more materials selected from the group consisting of metallic and metalloid elements and the oxides, hydroxides, and carbonates of these metallic or metalloid elements to produce a reaction product that is not part of any of components (A) through (F) as recited above; preferably this component results from reaction with silica or vanadium(V) oxide.

It should be understood that the components listed need not necessarily all be provided by separate chemicals. For example, "fluorometallate" salts of protonated polymer molecules of component (D) can be used to provide at least part of both of components (A) and (D). Also, if the acidity of the composition is sufficiently high and the substrate that is contacted with it is predominantly ferrous, component (B) can be provided by iron dissolved from the substrate and need not be present in the liquid composition when the liquid composition is first contacted with the substrate.

The pH value of an acidic aqueous liquid composition according to the invention preferably is at least, with increasing preference in the order given, 0.5, 1.0, 1.4, 1.7, 2.0, or 2.3 and independently preferably is not more than, with increasing preference in the order given, 5.0, 4.0, 3.5, 3.2, 2.9, 2.6, or 2.4.

Component (C) as defined above Is to be understood as including all of the following inorganic acids and their salts that may be present in the composition: hypophosphorous acid ($H_3PO_2$), orthophosphorous acid ($H_3PO_3$), pyrophosphoric acid ($H_4P_2O_7$), orthophosphoric acid ($H_3PO_4$), tripolyphosphoric acid ($H_5P_3O_{10}$), and further condensed phosphoric acids having the formula $H_{x+2}P_xO_{3x+1}$, where x is a positive integer greater than 3. Component (C) also includes all phosphonic acids and their salts. In a concentrated composition, the concentration in the total composition of phosphorus atoms contained in component (C) is preferably at least, with increasing preference in the order given, 0.05, 0.10, 0.15, 0.20, 0.25, 0.30, 0.34, 0.38, 0.42, or 0.45 moles of phosphorus atoms per kilogram of total composition (this unit of measure being hereinafter freely applied to any other constituent as well as to phosphorus and being hereinafter usually abbreviated as "M/kg") and independently preferably is not more than, with increasing preference in the order given, 2.0, 1.5, 1.0, 0.8, 0.60, 0.55, 0.50, or 0.47 M/kg.

Generally, inorganic phosphates, particularly orthophosphates, phosphites, hypophosphites, and/or pyrophosphates, especially orthophosphates, are preferred for component (C) because they are more economical. Phosphonates are also suitable and may be advantageous for use with very hard water, because the phosphonates are more effective chelating agents for calcium ions. Acids and their salts In which phosphorous has a valence less than five may be less stable than the others to oxidizing agents and are therefore less preferred in compositions according to the invention that are to contain oxidizing agents; such acids and their salts are less preferred in all instances for economy.

The polymers required for component (D) may be prepared by processes as described in one or more of the following U.S. Patents, the entire disclosures of all of which, except for any extent to which they may be inconsistent with any explicit statement herein, are hereby incorporated herein by reference: U.S. Pat. nos. 5,891,952, 5,116,912, 4,517,028, 4,433,015, and 4,376,000. Preferably, the polymers required for component (D) are made in a manner that reduces or eliminates the presence of organic solvent in the source of the polymer that is added to a mixture to make an acidic aqueous liquid composition according to the invention. Most preferably, these polymers are made by a method that does not use any organic solvent, as set forth further in the paragraphs following immediately below.

An aqueous solution of substituted aminomethylated polyphenol polymers produced by this preferred process is a product of reaction of:

(A') at least one precursor phenolic polymer or copolymer, which normally does not bear any substituted aminomethyl substituents on its aromatic rings;

(B') at least one aldehyde, ketone, or mixture thereof; and (C') at least one amine.

The preferred process comprises, preferably consists essentially of, or more preferably consists of, the following operations:

(I') reacting the precursor phenolic polymer component (A') in water with an organic or inorganic alkalinizing agent to form an aqueous solution of the corresponding phenoxide salt;

(II') mixing the aqueous solution from operation (I') with the amine component (C'), which preferably consists of one or more secondary amines, and the component (B') of aldehyde, ketone, or mixture thereof to form a single aqueous solution in which chemical reaction among components (A'), (B'), and (C') occurs at a temperature in the range from 20 to 100° C., preferably from 50 to 80° C., to attach substituted aminomethyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing agent added in operation (I') and to protonate a sufficient fraction of the amino nitrogen atoms in the substituted aminomethylated phenolic polymer to stabilize against settling the solution of the substituted aminomethylated phenolic polymer formed in operation (II'); and (IV') contacting the resulting aqueous solution from the end of operation (III') with a cation exchange resin in its protonated form to remove at least, with increasing preference in the order given, 50, 75, 90, 95, 99.0, 99.50, 99.70, 99.90, 99.95, or 99.98% of any inorganic and/or quaternary ammonium cations dissolved in said aqueous solution from the end of operation (III').

Ordinarily, as is known in the art, contacting is most conveniently, economically, and effectively, and therefore preferably, carried out by passing the aqueous solution through a bed of ion-exchange resin beads arranged in a vertical column of sufficient length that the desired level of removal of alkali metal and quaternary ammonium cations is achieved by the time the solution has passed through the entire column, and the ion-exchange resin in the column can later be returned to its protonated form by treatment with strong acid; however, many other methods of establishing contact between the solution and the ion-exchange resin for a sufficient time to remove the unwanted cations from the aqueous solution are known to those skilled in ion-exchange, and any of these methods may be used.

If It is desired, as is usually preferred, to remove unreacted amine as well as inorganic cations added as part of the alkalinizing agent, a strong acid cation exchange resin is used in operation (IV'). If it is desired to remove only inorganic cations, a weak acid cation exchange resin may be used instead. Suitable strong acid cation exchange resins are those of the sulfonic acid or phosphonic acid types, and suitable weak acid cation exchange resins are those of the carboxylic acid type.

The quantities of components (A'), (B') and (C') used to prepare the substituted aminomethylated polyphenol polymer product in aqueous solution preferably are such as to have the following ratios to one another, independently for each ratio specified:

the number of moles of carbonyl groups in component (B') has a ratio to the number of moles of primary and secondary amino nitrogen atoms in component (C') that is at least, with increasing preference in the order given, 0.5:1.00, 0.7:1.00, 0.80:1.00, 0.85:1.00, 0.90:1.00, 0.95:1.00, or 0.99:1.00 and independently preferably is not more than, with increasing preference in the order given, 1.5:1.00, 1.3:1.00, 1.20:1.00, 1.15:1.00, 1.10:1.00, 1.05:1.00, or 1.01:1.00;

the number of moles of carbonyl groups in component (B') has a ratio to the number of moles of aromatic rings in component (A') that is at least, with increasing preference in the order given, 0.10:1.00, 0.20:1.00, 0.30:1.00, 0.40:1.00, 0.50:1.00, 0.60:1.00, 0.70:1.00, 0.80:1.00, 0.85:1.00, 0.90:1.00, or 0.94:1.00 and independently preferably is not more than, with increasing preference in the order given, 2.00:1.00, 1.90:1.00, 1.80:1.00, 1.70:1.00, 1.60:1.00, 1.50:1.00, 1.40:1.00, 1.30:1.00, 1.20:1.00, 1.15:1.00, 1.10:1.00, 1.05:1.00, 1.00:1.00, or 0.96:1.00; and the number of moles of primary and secondary amino nitrogen atoms in component (C') has a ratio to the number of moles of aromatic rings in component (A') that is at least, with increasing preference in the order given, 0.10:1.00, 0.20:1.00, 0.30:1.00, 0.40:1.00, 0.50:1.00, 0.60:1.00, 0.70:1.00, 0.80:1.00, 0.85:1.00, 0.90:1.00, or 0.94:1.00 and independently preferably is not more than, with increasing preference in the order given, 2.00:1.00, 1.90:1.00, 1.80:1.00, 1.70:1.00, 1.60:1.00, 1.50:1.00, 1.40:1.00, 1.30:1.00, 1.20:1.00, 1.15:1.00, 1.10:1.00, 1.05:1.00, 1.00:1.00, or 0.96:1.00.

Additionally and independently, the quantities of components (A'), (B'), and (C') preferably are such as to provide an aqueous solution at the end of operation (IV') that contains at least, with increasing preference in the order given, 1.0, 3.0, 5.0, 6.0, 7.0, 7.5, 8.0, 8.5, 9.0, 9.5, or 10.0 percent of the total mass of the aqueous solution as polymer molecules that satisfy the definition for component (A) as given above. To avoid impractically high viscosity of the solution, such polymer molecules independently preferably constitute not more than, with increasing preference in the order given, 50, 35, or 30% of the total mass of the aqueous solution.

In operation (I') the alkalinizing agent is preferably, for economy, an alkali metal hydroxide, e.g. sodium or potassium hydroxide, although tetraalkylammonium hydroxides, e.g. tetrabutylammonium hydroxide, or tetraarylammonium hydroxides can also be used with technically satisfactory results. A sufficient number of moles of alkalinizing agent should be present to correspond to at least, with increasing preference in the order given, 10, 15, 20, or 25% of the number of moles of phenolic hydrogen atoms in component (A').

Operation (I') is preferably carried out at a temperature that is at least, with increasing preference in the order given, 30, 40, 50, 55, 60, or 65° C., in order to minimize the amount of neutralizing agent that is needed in operation (I') by increasing the solubility, or at least the speed of dissolution, in water of at least partially neutralized polymer molecules formed in this step. Primarily for operating convenience when using process equipment that is not easily pressurized, the temperature during operation (I') independently preferably is not more than, with increasing preference in the order given, 95, 90, 80, or 70° C.

In operation (III') the acid used to neutralize the alkalinizing agent can be organic or inorganic. Suitable acids for this purpose include carbonic acid, acetic acid, citric acid, oxalic acid, ascorbic acid, phenylphosphonic acid, chloromethylphosphonic acid; mono-, di- and tri-chloroacetic acids, trifluoroacetic acid, nitric acid, phosphoric acid, hydrofluoric acid, tetrafluoroboric acid, hexafluorotitanic acid, hexafluorosilicic acid, hexafluorozirconic acid, sulfuric acid, boric acid, hydrochloric acid, and the like. The most preferred acid is a mixture of at least one of the "fluorometallic" acids with phosphoric acid. This mixture is preferred at least for economy, because when these two acids are used as neutralizers in the preparation of an aqueous solution and/or dispersion of necessary component (D), this solution and/or dispersion provides at least part of both components (A) arid (C), which are also needed for a composition according to this invention.

Component (A'), i.e., the precursor phenolic polymer or copolymer, is preferably selected from polymer molecules in which at least, with increasing preference in the order given, 10, 20, 30, 40, 50, 60, 70, 80, or 90% of the mass of the polymer molecules is constituted of moieties that conform to one of the two following general formulas, or would so conform if one of the open bonds shown in the following general formulas were replaced by a bond to a hydrogen atom:

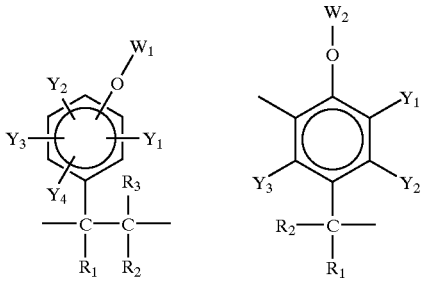

wherein, in either or both of these general formulas when present:

each of $R_1$ through $R_3$ is independently selected from the group consisting of a hydrogen atom, alkyl moieties having from 1 to 5 carbon atoms, and aryl moieties having from 6 to 18, carbon atoms;

each of $Y_1$ through $Y_4$ is independently selected from the group consisting of a hydrogen atom and alkyl and aryl moieties having from 1 to 18 carbon atoms; and $W_1$ or $W_2$ is selected from the group consisting of a hydrogen atom and hydrolyzable moieties, preferably an acyl group, e.g. acetyl, benzoyl, and the like.

Most preferably, independently for each such element of the formula, each of $R_1$ through $R_3$, $Y_1$ through $Y_4$, $W_1$, and $W_2$, is a hydrogen atom.

The weight average molecular weight of component (A') preferably is at least, with increasing preference in the order given, 500, 1000, 1500, 2000, 2400, 2800, 3200, 3600, 4000, 4300, 4600, 4800, or 4900 Daltons and independently preferably is not more than, with increasing preference in the order given, 30,000, 25,000, 20,000, 15,000, 10,000, 8000, 6000, or 5100 Daltons.

Component (B') is preferably an aldehyde, and most preferably is formaldehyde, especially in the form of paraformaldehyde. Liquid formaldehyde is generally commercially available only in a form that contains a significant quantity of methanol, e.g. 15% methanol, as a polymerization inhibitor for the formaldehyde. Since the preferred process is carried out in the absence of organic solvents, formaldehyde free from methanol, such as uninhibited aqueous formaldehyde or paraformaldehyde, is preferably used.

Component (C') is selected from amine molecules, preferably exclusively from secondary amines, still more preferably from secondary amines in which the total number of carbon atoms is not more than, with increasing preference in the order given, 10, 8, 6, 4, or 3. Examples of suitable secondary amines are methyl methanol amine, methyl ethanol amine, methyl butano amine, ethyl methanol amine, ethyl ethanol amine, pentyl ethanol amine, pentyl pentanol amine, hexyl ethanol amine, dimethanol amine, diethanol amine, dipropanol amine, dibutanol amine, dipentanol amine, nonyl methanol amine, octyl ethanol amine, and the like. Primary amines, such as $C_1$–$C_{12}$ alkyl and alkanol amines and the like, can also be used. Most preferably, component (C') is selected from secondary amines in which one of the organic moieties bonded directly to the amino nitrogen atom in the amine is an unsubstituted alkyl moiety and the other is a hydroxyl substituted but otherwise unsubstituted alkyl moiety. The single most preferred substance for component (C') is methyl ethanol amine with the formula $H_3C—NH—(CH_2)_2OH$.

Even if component (D) of a composition according to this invention is in fact made by some other method than the preferred method described in the immediately preceding paragraphs, its chemical characteristcs preferably are, with the same degree of preference, those that would result from being made according to this preferred method with preferred choices as indicated above.

The term "stabilize(d) against settling" in the description above of component (G) and of operation (III') means that the composition containing the material does not suffer any visually detectable settling or separation into distinct liquid phases when stored, without mechanical agitation, for a period of 100, or more preferably 1000, hours at 25° C.

Materials for component (G) may be prepared by mixing the two types of reagents noted in the definition for component (G). A spontaneous chemical reaction normally ensues, converting the added element, oxide, hydroxide, or carbonate into a soluble species. The reaction to form this soluble species can be accelerated by use of heat and by stirring or other agitation of the composition. The formation of the soluble species is also aided by the presence in the composition of suitable complexing ligands, such as peroxide and fluoride.

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: organic materials that are liquid at 25° C. under normal atmospheric pressure and have a vapor pressure of at least 0.05 bar at 25° C.; hexavalent chromium: ferricyanide; ferrocyanide; sulfates and sulfuric acid; alkali metal and ammonium cations; pyrazole compounds; sugars; gluconic acid and its salts; glycerine; α-glucoheptanoic acid and its salts; and myo-inositol phosphate esters and salts thereof.

Furthermore, in a process according to the invention that includes other operations than the drying into place on the surface of the metal of a layer of a composition as described above, it is preferred that none of these other operations include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium, except that a final protective coating system including an organic binder, more particularly those including a primer coat, may include hexavalent chromium as a constituent. Any such hexavalent chromium in the protective coating is generally adequately confined by the organic binder, so as to avoid adverse environmental impact.

In one embodiment of the invention, it is preferred that the acidic aqueous composition as noted above be applied to the metal surface and dried thereon within a short time interval. With increasing preference in the order given, the time interval during which the liquid coating is applied to the metal being treated and dried in place thereon, when heat is used to accelerate the process, is not more than 25, 15, 9, 7, 4, 3, 1.8, 1.0, or 0.7 second (hereinafter often abbreviated "sec"). In order to facilitate this rapid completion of a process according to this invention, it is preferred to apply the acid aqueous composition used in the invention to a heated metal surface, such as one rinsed with hot water and subsequently dried after initial cleaning and very shortly before treating with the aqueous composition according to this invention, and/or to use infrared or microwave radiant heating and/or convection heating in order to effect very fast drying of the applied coating. Preheating of the metal substrate before application of a composition according to the invention is preferred over postheating of the applied liquid composition when practical, because the latter is more likely to result in unwanted deformation of the coating film or inhomogeneous properties of the film as a result of more rapid drying in some areas than in others. Whether preheating, postheating, or both are used, the peak metal temperature preferably is in a range from, with increasing preference in the order given, 10–100, 15–95, 20–90, 20–80, or 20–70° C.

In an alternative embodiment, which is equally effective technically and is satisfactory when ample time is available at acceptable economic cost, a composition according to this invention may be applied to the metal substrate and allowed to dry at a temperature not exceeding 40° C. In such a case, there is no particular advantage to fast drying. This alternative embodiment is particularly advantageously used for "touching up" thinned or damaged coatings that are already in place over most of the surface of some article that is too large to fit into any conveniently available oven or other heating device. For such uses a composition according to the invention is advantageously applied to the substrate to be treated with the aid of an applicator as taught in U.S. Pat. No. 5,702,759 of Dec. 30, 1997 to White et al., the entire disclosure of which, except to any extent that may be inconsistent with any explicit statement herein, is hereby incorporated herein by reference.

The effectiveness of a treatment according to the invention appears to depend predominantly on the total amounts of the active ingredients that are dried in place on each unit area of the treated surface, and on the nature and ratios of the active ingredients to one another, rather than on the concentration of the acidic aqueous composition used. Thus, if the surface to be coated is a continuous flat sheet or coil and precisely controllable coating techniques such as roll coaters are used, a relatively small volume per unit area of a concentrated composition may effectively be used for direct application. On the other hand, with some coating equipment, it is equally effective to use a more dilute acidic aqueous composition to apply a heavier liquid coating that contains about the same amount of active ingredients. As a general guide, it is normally preferable, independently for each preference stated, for a working composition according to the invention that is intended to be dried without substantial external heating and/or to be applied without precise control of the total amount applied to have:

- a total concentration of "fluorometallate" anions of component (A) that is at least, with increasing preference in the order given, 0.005, 0.010, 0.020, 0.030, 0.035, 0.040, 0.050, or 0.055 M/kg;
- a total concentration of metal cations of component (B) that is at least, with increasing preference in the order given, 0.007, 0.011, 0.020, 0.030, 0.035, 0.040, 0.045, 0.050, 0.054, 0.058, or 0.062 M/kg;
- a ratio of total concentration in M/kg of metal cations of component (B) in M/kg to the total concentration in M/kg of "fluorometallate" anions of component (A) in the same composition that is at least, with increasing preference in the order given, 0.2:1.0, 0.4:1.0, 0.60:1.00, 0.70:1.00, 0.80:1.00, 0.90:1.00, 0.95:1.00, 1.00:1.00, 1.05:1.00, 1.10:1.00, or 1.12:1.00 and independently preferably is not more than, with increasing preference in the order given, 3.0:1.00, 2.6:1.00, 2.2:1.00, 1.8:1.00, 1.6:1.00, 1.40:1.00, 1.30:1.00, 1.20:1.00, or 1.13:1.00;
- a concentration of phosphorus from component (C) that is at least, with increasing preference in the order given, 0.007, 0.012, 0.017, 0.022, 0.027, 0.032, 0.037, 0.042, 0.047, 0.052, 0.057, 0.062, or 0.067 M/kg;
- a ratio of moles of phosphorus from component (C) to moles of "fluorometallate" ions from component (A) in the same composition that is at least, with increasing preference in the order given, 0.2:1.0, 0.4:1.0, 0.60:1.00, 0.70:1.00, 0.80:1.00, 0.90:1.00, 0.95:1.00, 1.00:1.00, 1.05:1.00, 1.10:1.00, 1.15:1.00, or 1.19:1.00 and independently preferably is not more than, with increasing preference in the order given, 3.0:1.00, 2.6:1.00, 2.2:1.00, 1.8:1.00, 1.6:1.00, 1.40:100, 1.30:1.00, 1.25:1.00, or 1.20:1.00;
- a ratio of moles of phosphorus from component (C) to moles of total metal cations from component (B) in the same composition that is at least, with increasing preference in the order given, 0.2:1.0, 0.4:1.0, 0.60:1.00, 0.70:1.00, 0.80:1.00, 0.90:1.00, 0.95:1.00, 1.00:1.00, or 1.05:1.00 and independently preferably is not more than, with increasing preference in the order given, 2.6:1.00, 2.2:1.00, 1.8:1.00, 1.6:1.00, 1.40:1.00, 1.30:1.00, 125:1.00, 1.20:1.00, 1.15:1.00, 1.11:1.00, or 1.07:1.00;
- a concentration of moles of substituted phenol moieties from component (D) that is at least, with increasing preference in the order given, 0.004, 0.008, 0.012, 0.018, 0.024, 0.028, or 0.031 M/kg;
- a ratio of moles of substituted phenol moieties from component (D) to moles of total "fluorometallate" anions from component (A) in the same composition that is at least, with increasing preference in the order given, 0.060:1.00, 0.12:1.00, 0.16:1.00, 0.20:1.00, 0.25:1.00, 0.30:1.00, 0.35:1.00, 0.40:1.00, 0.43:1.00, 0.46:1.00, 0.49:1.00, or 0.54:1.00 and independently preferably is not more than, with increasing preference in the order given, 2.0:1.00, 1.5:1.00, 1.0:1.00, 0.80:1.00, 0.70:1.00, 0.65:1.00, 0.61:1.00, or 0.57:1.00;
- a ratio of moles of substituted phenol moieties from component (D) to moles of total metal cations from component (B) in the same composition that is at least, with increasing preference in the order given, 0.060:1.00, 0.1 2:1.00, 0.16:1.00, 0.20:1.00, 0.25:1.00, 0.30:1.00, 0.35:1.00, 0.40:1.00, 0.43:1.00, 0.46:1.00, or 0.49:1.00 and independently preferably is not more than, with increasing preference in the order given, 2.0:1.00, 1.5:1.00, 1.0:1.00, 0.60:1.00, 0.70:1.00, 0.65:1.00, 0.61:1.00, 0.57:1.00, 0.54:1.00 or 0.51:1.00;
- a ratio of moles of substituted phenol moieties from component (D) to moles of phosphorus from component (C) in the same composition that is at least, with increasing preference in the order given, 0.060:1.00, 0.12:1.00, 0.16:1.00, 0.20:1.00, 0.25:1.00, 0.30:1.00, 0.35:1.00, 0.40:1.00, 0.43:1.00, or 0.46:1.00 and independently preferably is not more than, with increasing preference in the order given, 2.0:1.00, 1.5:1.00, 1.0:1.00, 0.80:1.00, 0.70:1.00, 0.65:1.00, 0.61:1.00, 0.57:1.00, 0.54:1.00, 0.51:1.00, or 0.48:1.00.

Working compositions containing up to from five to ten times these amounts of active ingredients are also generally fully practical to use when coating control is precise enough to meter relatively thin uniform films of working composition onto the metal surface to be treated according to the invention. Concentrations of at least six times the values given above are also preferred for concentrated compositions from which working compositions within the more preferred ranges given above are to be made by dilution with water.

Ordinarily, at least for economy, all of the optional components indicated above are preferably omitted, because satisfactory quality can be obtained without them. They may be useful in special situations, however.

Preferably the amount of composition applied in a process according to this invention is chosen so as to result in a total add-on mass (after drying) in the range from 5 to 500 milligrams per square meter of the substrate surface treated (this unit of add-on mass being hereinafter usually abbreviated as "mg/m$^2$"), more preferably from 10 to 400 mg/m$^2$, or still more preferably from 50 to 300 mg/m$^2$. The add-on mass of the protective film formed by a process according to the invention may be conveniently monitored and controlled by measuring the add-on weight or mass of the metal atoms in the anions of component (A) as defined above. The amount of these metal atoms may be measured by any of several conventional analytical techniques known to those skilled in the art. The most reliable measurements generally involve dissolving the coating from a known area of coated substrate and determining the content of the metal of interest in the resulting solution. The total add-on mass can then be calculated from the known relationship between the amount of the metal in component (A) and the total mass of the part of the total composition that remains after drying. For the purpose of this calculation it is assumed that all water in the working composition, including any water of hydration in any solid constituent added to the composition during its preparation, is expelled by drying but that all other constituents of the liquid film of working composition coated onto the surface measured remain in the dried coating. In many instances, fully practically satisfactory quality can be achieved by experience in judging the visual appearance of the coating, without directly measuring the amount of coating added on at all.

A working composition according to the invention may be applied to a metal work-piece and dried thereon by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller Immersed in a container of the liquid composition, and the like, or by a mixture of methods. Excessive amounts of the liquid composition that might otherwise remain on some part of the surface prior to drying may be removed before drying by any convenient method, such as drainage under the influence of gravity, squeegees, passing between rolls, wiping with a towel or other absorbent material, and the like. Alternatively, the excess may simply be dried into place on the surface, and any area of the dried substrate that exhibits a powdery appearance as a result of dried excess amounts of coating material can usually be made uniform in appearance by wiping the powdery areas with a soft cloth or similar material to remove the powdery excess of dried coating. (insofar as it has been measured, the protective quality of the coating is also uniform after such wiping to remove any powdery excess.) Drying also may be accomplished by any convenient method, such as a hot air oven, exposure to infra-red radiation, microwave heating, and the like.

For flat and particularly for continuous flat workpieces such as sheet and coil stock, application by a roller set in any of several conventional arrangements, followed by drying in a separate stage, is generally preferred. The temperature during application of the liquid composition may be any temperature within the liquid range of the composition, although for convenience and economy in application by roller coating, normal room temperature, i.e., from 20–30° C., is usually preferred. In most cases for continuous processing of coils, rapid operation is favored, and in such cases drying by infrared radiative heating, to produce a peak metal temperature in the range already given above, is generally preferred.

Alternatively, particularly if the shape of the substrate is not suitable for roll coating, a composition may be sprayed onto the surface of the substrate and allowed to dry in place. Such cycles can be repeated as often as needed until the desired thickness of coating, generally measured in $mg/m^2$, is achieved. For this type of operation, it is preferred that the temperature of the metal substrate surface during application of the working composition be in the range from 20 to 300, more preferably from 30 to 100, or still more preferably from 30 to 90° C.

Preferably, the metal surface to be treated according to the invention is first cleaned of any contaminants, particularly organic contaminants and foreign metal fines and/or inclusions. Such cleaning may be accomplished by methods known to those skilled in the art and adapted to the particular type of metal substrate to be treated. For example, if predominantly chemical cleaning is desired, for galvanized steel substrates, the surface is most preferably cleaned with a conventional hot alkaline cleaner, then rinsed with hot water, squeegeed, and dried. For aluminum substrates, the surface to be treated most preferably is first contacted with a conventional hot alkaline cleaner, then rinsed in hot water, then, optionally, contacted with a neutralizing acid rinse, before being contacted with an acid aqueous composition as described above. Abrasive cleaning, particularly with high-loft type coated abrasive products, may also be used effectively before treatment according to this invention.

The invention is particularly well adapted to treating surfaces that are to be subsequently further protected by applying conventional organic protective coatings such as paint, lacquer, and the like over the surface produced by treatment according to the invention.

The practice of this invention may be further appreciated by consideration of the following, non-limiting, working and comparison examples.

An aqueous solution of a polymer for component (D) of a composition according to the invention was prepared as follows: To a 500 milliliter (hereinafter usually abbreviated as "ml") size three-neck round bottom flask equipped with an overhead stirrer, reflux condenser, nitrogen gas inlet, heating mantle and thermocouple, about 350 grams (hereinafter usually abbreviated as "g") of deionized water, 4.2 grams of sodium hydroxide, and 29.1 g of N-methyl ethanolamine were added and mixed till dissolved. 48.4 g of solid poly(4-hydroxystyrene) with a weight average molecular weight of about 5000 Daltons was then added with mixing. The mixture was then heated to 65° C. with mechanical agitation. After 1.5 hours of mixing at 65° C. the polymer was completely dissolved. The resulting solution was then allowed to cool to 30° C. and 12.5 g of paralormaldehyde containing 92% stoichiometric equivalent as formaldehyde (i.e., HCHO) was added with continued mixing. After 30 minutes, the paraformaldehyde was completely dissolved. The solution was then heated with mixing to 65° C. and held at that temperature for 1.5 hours. Heating was then discontinued, and after the solution had cooled to about 30° C., the solution was transferred to a 1500 ml beaker equipped with a stirrer, and therein diluted with about 500 grams of deionized water. The resulting solution was well mixed; 33.4 g of 75% phosphoric acid (i.e., $H_3PO_4$) in water was added quickly. After this addition, the solution changed from transparent to very turbid; the solution then became transparent again within one hour. The pH at this stage was 6.7.

The solution was then passed through an ion-exchange column containing at least 100 ml of Rohm and Haas IR-120+ cation exchange resin. The resulting pH was 5.4; the sodium concentration was less than 1 part of sodium per million parts of the solution, a concentration unit that may be freely used hereinafter for specifying the concentration of any noted material and is hereinafter usually abbreviated as "ppm", and the residual formaldehyde concentration was about 90 ppm. 3.0 g of 60% fluorotitanic acid (i.e., $H_2TiF_6$) and sufficient deionized water to give a total mass of 1000 g of the solution were then added with mixing. The final solution contained 10.2% non-volatile solids on drying.

A concentrate according to the invention was prepared as follows: 24.6 parts of deionized water, 3.51 parts of 75% $H_3PO_4$ in water solution, and 8.22 parts of 60% $H_2TiF_6$ in water solution were mixed to form a homogeneous liquid. To this was slowly added 2.44 parts of solid MnO, with stirring and cooling, and after apparent homogeneity had been achieved, stirring was continued for 30 minutes. Finally, to this mixture was added 42.2 parts of the 10.2% solution of substituted aminomethylated phenolic polymer prepared as described in the immediately preceding paragraph.

A working composition according to the invention was made by mixing the concentrate described in the immediately preceding paragraph with deionized water to give a homogeneous liquid containing 15% of the concentrate. For use, this working composition was put into the reservoir of an applicator as taught in U.S. Pat. No. 5,702,759.

Conventional cold rolled steel test panels were prepared for use by rubbing with a water-wetted Scotch-Brite™ 96General Purpose Scouring Pad (a high loft coated abrasive pad commercially supplied by Minnesota Mining & Manufacturing Co. ) once in a lengthwise direction, next in a cross-direction, and once again in a lengthwise direction, then rinsing with hot tap water and finally wiping dry with a clean, dry, lint-free towel (Kay-dry™ EX-L 34705 Delicate Task Wiper commercially supplied by Kimberly-Clark) immediately before contact with whatever treatment liquid was to be used on the particular panels. In a process example according to the invention, panels thus cleaned were wiped sparingly with the felt tip of the applicator wetted with the working composition described in the immediately preceding paragraph. Each wiping stroke of the applicator was spaced so that about half of the width of the immediately previously coated width of the substrate was overlapped, but puddling of the liquid was avoided. (The wetness of the felt tip can be controlled by activating the plunger valve of the applicator more or less often and/or by using shorter or longer periods of valve opening. If any excessive amount of liquid is deposited in a particular area, the excess amount of it can be removed by wiping with the applicator felt after its most recent supply of liquid from the reservoir of the applicator has been substantially diminished by contact with another part of the metal substrate.) The residue of liquid was then allowed to dry in the ambient air. Some streaked areas of white dust, indicative of more than optimal liquid coating thickness, were observed on the surface after drying. These areas were gently brushed away with a clean, soft, dry towel before further treatment of the panels, and underneath these formerly dusty areas the same bluish coating as on the remainder of the panel was observed.

In Comparison Example 1, abrasive cleaning and subsequent drying as described above for the example according to the invention were used without any subsequent treatment before painting. In the remaining comparison examples, the same abrasive cleaning and subsequent drying were used prior to the following prepainting treatments as specified:

COMPARISON EXAMPLE 2

The cleaned substrates were treated with TOUCH-N-PREP® ALODINE® 1132, a commercial product available from the Henkel Surface Technologies Div. of Henkel Corporation, Madison Heights, Mich., U.S.A. This product contains as its active ingredients hexavalent and trivalent chromium, fluorozirconic acid, and phosphoric acid and also contains a fluorinated surfactant.

COMPARISON EXAMPLE 3

This was first treated as for Comparison Example 2, dried, and then post-rinsed with a 0.25% solution in water of the aqueous solution in water of poly(vinyl phenol) grafted with substituted aminomethyl moieties that was used to provide component (D) for the concentrate according to the invention as described above.

COMPARISON EXAMPLE 4

An aqueous solution of an amine oxide type substituted phenolic polymer was prepared as follows: To a 2000 ml size three-neck round bottom flask equipped with an overhead stirrer, reflux condenser, nitrogen gas inlet, heating mantle; and thermocouple, about 1300 g of deionized water, 18.8 g of sodium hydroxide, 129.1 g of N-methyl ethanolamine, and 215 g of solid poly(4-hydroxy styrene) with a weight average molecular weight of about 5000 Daltons were added and mixed till dissolved. The mixture was then heated to 65° C. with mixing. After 1.5 hours of mixing at 65° C. the polymer and all other materials added were completely dissolved. The resulting solution was then allowed to cool to 30° C. and 55.6 g of paraformaldehyde containing 92% stoichiometric equivalent as formaldehyde (i.e., HCHO) and 114 g of additional deionized water were added with continued mixing. After 30 minutes, the paraformaldehyde was completely dissolved. The solution was then heated with mixing to 65° C. and held at that temperature for 1.5 hours. Heating was then discontinued, and after the solution had cooled to about 30° C., the solution was diluted with 1784 g of additional deionized water, then mixed rapidly with 104 g of 31% $H_2O_2$ in water and 28 g of 14.6% $H_2O_2$ in water. The solution became viscous with a heavy precipitate, but after hand mixing and continued mechanical stirring for about 40 minutes, the mixture became transparent and homogeneous again. The resulting mixture was continuously stirred mechanically for about 16 hours, and was then passed through an ion-exchange column filled with 500 ml of acid form Rohm and Haas IR-120+ cation exchange resin. A yield of 3.8 kilograms (hereinafter usually abbreviated as "kg") of solution with a pH of 8.1 resulted. To this was added 0.19 kg of 20% $H_2ZrF_6$ solution in water, resulting in a total mass of 4.0 kg. Finally, to 1.0 kg of this, 46 g of additional 20% $F_2ZrF_6$ solution in water was added, resulting in a final amine oxide substituted phenolic polymer solution with a pH of 3.4. The working composition for Comparison Example 4 consisted of a 0.25% solution in water of this final amine oxide substituted phenolic polymer solution.

COMPARISON EXAMPLE 5

For this example, an aqueous solution of a substituted aminomethylated phenolic polymer with polyhydroxyalkyl substituents on the amino nitrogen atoms was made as follows: 83 parts of propoxylated propane solvent (PROPASOL™ P from Union Carbide) and 38 parts of solid poly(4-hydroxy styrene) with a weight average molecular weight of 5000 Daltons were mixed until homogeneous. Then 62 parts of N-methylglucamine slurried in about 100 parts of deionized water were added to this mixture, and the resulting mixture was warmed with stirring to 65° C., after which 25 parts of a solution in water of 37% formaldehyde (also containing 11% of pure methanol to inhibit polymerization of the formaldehyde) were added over the course of 45 minutes. The resulting reaction product containing mixture was then heated to 90° C. and held at that temperature for 6 hours. After cooling, 4.2 parts of 75% $H_3PO_4$ solution in water was added, and finally the entire mixture was diluted with deionized water to constitute 1000 total parts.

To make the working treatment composition for Comparative Example 5, 602 parts of the polymer solution made as described in the immediately preceding paragraph was mixed with a precursor mixture formed by mixing 45 parts of 75% $H_3PO_4$ solution in water, 82 parts of a 60% solution of $H_2TiF_6$, and 24 parts of solid MnO, the latter being added slowly in solid form to the mixture of the two acids with stirring and cooling.

COMPARISON EXAMPLE 6

The working treatment composition for this was GALVAPREP™ SG nickel modified zinc phosphating composition, prepared and used as directed by its manufacturer, the Henkel Surface Technologies Div. of Henkel Corporation, Madison Heights, Mich., U.S.A.

Three panels were treated with the working composition according to the invention as described above and according to each of the Comparison Examples 1–6 as described above and were subsequently painted with PPG ED5050B cathodically electrodeposited paint. The painted panels were then submitted to accelerated corrosion testing, as further detailed in Table 1 below.

TABLE 1

| | Result after Test for: | | | | | | |
|---|---|---|---|---|---|---|---|
| | | Comparative Example: | | | | | |
| Test Identification | Example | 1 | 2 | 3 | 4 | 5 | 6 |
| Ford Scab (FLTM BI 123-01) Salt Spray (504 Hours) - Rated by: | 1.6 | 36 | 1.4 | 1.8 | 33 | 24 | 24 |
| Maximum Creep, Millimeters | $1.4^S$ | $3.2^S$ | $1.4^S$ | $1.5^S$ | $3.4^S$ | $1.4^S$ | $1.8^S$ |
| Average Creep, Millimeters | 0.9 | 1.3 | 0.8 | 0.8 | 2.2 | 0.7 | 0.6 |
| ASTM Overall | 8 | 7 | 8 | 8 | 6 | 8 | 8 |

In addition to the results shown in Table 1, all of the samples had the same ratings in other tests or rating methods, as follows: Salt spray rated by minimum creep, 00; Conical Mandrel, 10; Reverse Impact, 10; Knife Adhesion, 5B; and 1008 hours humidity testing according to American Society for Testing and Materials Method D2247, 10. The example according to the invention is clearly far better in performance in the aggressive cyclic "scab" test than any of the comparison examples, except for those that utilize hexavalent chromium, with its accompanying pollution concerns.

What is claimed is:

1. An acidic aqueous liquid composition that is suitable for use directly, after being diluted with water, or both directly and after being diluted with water, for generating a corrosion reducing coating over a metal surface when contacted therewith, said composition comprising water and:

(A) a component of "fluorometallate" anions, each of said anions consisting of (i) at least four fluorine atoms, (ii) at least one atom of an element selected from the group consisting of titanium, zirconium, hafnium, silicon, aluminum, and boron, and optionally, one or both of (iii) ionizable hydrogen atoms, and (iv) one or more oxygen atoms;

(B) a component of divalent or tetravalent cations of elements selected from the group consisting of cobalt, magnesium, manganese, zinc, nickel, fin, copper, zirconium, iron, and strontium;

(C) a component selected from the group consisting of phosphorus-containing inorganic oxyanions and phosphonate anions; and (D) a component of water-soluble, water-dispersible, or both water-soluble and water-dispersible polymers of hydroxy styrene, modified by substitution on the aromatic rings of the polymers of at least mono-substituted aminomethyl moieties, in which the substituents (other than the carbon atom that is directly bonded to an aromatic ring in the polymer) on the amino nitrogen atom jointly contain at least two carbon atoms and at least one hydroxy moiety but neither of these substituents individually contains more than half as many hydroxyl moieties as it has carbon atoms, unless it contains only one carbon atom.

2. An acidic aqueous liquid composition according to claim 1, wherein:

there is a total concentration of "fluorometallate" anions of component (A) that is at least about 0.010 M/kg;

there is a total concentration of metal cations of component (B) that is at least about 0.020 M/kg;

there is a ratio of total concentration in M/kg of metal cations of component (B) in M/kg to the total concentration in M/kg of "fluorometallate" anions of component (A) that is in a range from about 0.4:1.0 to about 1.6:1.00;

there is a concentration of phosphorus from component (C) that is at least about 0.017 M/kg;

there is a ratio of moles of phosphorus from component (C) to moles of "fluorometallate" ions from component (A) that is in a range from about 0.60:1.00 to about 2.6:1.00;

there is a ratio of moles of phosphorus from component (C) to moles of total metal cations from component (B) that is from about 0.4:1.0 to about 2.2:1.00;

there is a concentration of moles of substituted phenol moieties from component (D) that is at least about 0.008 M/kg;

there is a ratio of moles of substituted phenol moieties from component (D) to moles of total "fluorometallate" anions from component (A) that is from about 0.12:1.00 to about 1.5:1.00;

there is a ratio of moles of substituted phenol moieties from component (D) to moles of total metal cations from component (B) that is from about 0.12:1.00 to about 1.5:1.00; and there is a ratio of moles of substituted phenol moieties from component (D) to moles of phosphorus from component (C) that is from about 0.12:1.00 to about 1.5:1.00.

3. An acidic aqueous liquid composition according to claim 2, wherein:

component (A) is selected from the group consisting of fluorotitanate and fluorozirconate;

at least 60% of component (B) is selected from the group consisting of divalent manganese, cobalt, nickel, and magnesium; and there is not more than 0.10% of organic materials that are liquid at 25° C. under normal atmospheric pressure and have a vapor pressure of at least 0.05 bar at 25° C.

4. An acidic aqueous liquid composition according to claim 3, wherein component (D) has the chemical characteristics of a polymer that is a product of reaction of:

(A') at least one precursor phenolic polymer or copolymer which does not bear any substituted aminomethyl substituents on its aromatic rings;

(B') at least one aldehyde, ketone, or mixture thereof; and (C') at least one amine.

5. An acidic aqueous liquid composition according to claim 4, wherein:

the number of moles of carbonyl groups in component (B') has a ratio to the number of moles of primary and secondary amino nitrogen atoms in component (C') that is from about 0.5:1.00 to about 1.5:1.00;

the number of moles of carbonyl groups in component (B') has a ratio to the number of moles of aromatic rings in component (A') that is from about 0.20:1.00 to about 2.00:1.00; and the number of moles of primary and secondary amino nitrogen atoms in component (C') has a ratio to the number of moles of aromatic rings in component (A') that is from about 0.20:1.00 to about 2.00:1.00.

6. An acidic aqueous liquid composition according to claim 5, wherein component (D) has been made by a process comprising the following operations:

(I') reacting the precursor phenolic polymer component (A') in water with an organic or inorganic alkalinizing agent to form an aqueous solution of the corresponding phenoxide salt;

(II') mixing the aqueous solution from operation (I') with the amine component (C') and the component (B') of aldehyde, ketone, or mixture thereof to form a single aqueous solution in which chemical reaction among components (A'), (B'), and (C') occurs at a temperature in a range from about 20 to about 100° C. to attach substituted aminomethyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing agent added in operation (I') and to protonate a sufficient fraction of the amino nitrogen atoms in the substituted aminomethylated phenolic polymer to stabilize against settling the solution of the substituted aminomethylated phenolic polymer formed in operation (II'); and (IV') contacting the resulting aqueous solution from the end of operation (III') with a cation exchange resin in its protonated form to remove at least about 75% of any inorganic and/or quaternary ammonium cations dissolved in said aqueous solution from the end of operation (III').

7. An acidic aqueous liquid composition according to claim 6, wherein:

there is a total concentration of "fluorometallate" anions of component (A) that is at least about 0.040 M/kg;

there is a total concentration of metal cations of component (B) that is at least about 0.054 M/kg;

there is a ratio of total concentration in M/kg of metal cations of component (B) in M/kg to the total concentration in M/kg of "fluorometallate" anions of component (A) that is in a range from about 1.00:1.00 to about 1.30:1.00;

there is a concentration of phosphorus from component (C) that is at least about 0.057 M/kg;

there is a ratio of moles of phosphorus from component (C) to moles of "fluorometallate" ions from component (A) that is in a range from about 1.00:1.00 to about 1.40:1.00;

there is a ratio of moles of phosphorus from component (C) to moles of total metal cations from component (B) that is from about 0.80:1.00 to about 1.25:1.00;

there is a concentration of moles of substituted phenol moieties from component (D) that is at least about 0.024 M/kg;

there is a ratio of moles of substituted phenol moieties from component (D) to moles of total "fluorometallate" anions from component (A) that is from about 0.40:1.00 to about 0.80:1.00;

there is a ratio of moles of substituted phenol moieties from component (D) to moles of total metal cations from component (B) that is from about 0.35:1.00 to about 0.70:1.00; and there is a ratio of moles of substituted phenol moieties from component (D) to moles of phosphorus from component (C) that is from about 0.30:1.00 to about 0.65:1.00.

8. An acidic aqueous liquid composition according to claim 1, wherein:

component (A) is selected from the group consisting of fluorotitanate and fluorozirconate;

at least 60% of component (B) is selected from the group consisting of divalent manganese, cobalt, nickel, and magnesium; and there is not more than 0.10% of organic materials that are liquid at 25° C. under normal atmospheric pressure and have a vapor pressure of at least 0.05 bar at 25° C.

9. An acidic aqueous liquid composition according to claim 8, wherein component (D) has the chemical characteristics of a polymer that is a product of reaction of:

(A') at least one precursor phenolic polymer or copolymer which does not bear any substituted aminomethyl substituents on its aromatic rings;

(B') at least one aldehyde, ketone, or mixture thereof; and (C') at least one amine.

10. An acidic aqueous liquid composition according to claim 9, wherein:

the number of moles of carbonyl groups in component (B') has a ratio to the number of moles of primary and secondary amino nitrogen atoms in component (C') that is from about 0.5:1.00 to about 1.5:1.00;

the number of moles of carbonyl groups in component (B') has a ratio to the number of moles of aromatic rings in component (A') that is from about 0.20:1.00 to about 2.00:1.00; and the number of moles of primary and secondary amino nitrogen atoms in component (C') has a ratio to the number of moles of aromatic rings in component (A') that is from about 0.20:1.00 to about 2.00:1.00.

11. An acidic aqueous liquid composition according to claim 10, wherein component (D) has been made by a process comprising the following operations:

(I') reacting the precursor phenolic polymer component (A') in water with an organic or inorganic alkalinizing a gent to form an aqueous solution of the corresponding phenoxide salt;

(II') mixing the aqueous solution from operation (I') with the amine component (C') and the component (B') of aldehyde, ketone, or mixture thereof to form a single aqueous solution in which chemical reaction among components (A'), (B'), and (C') occurs at a temperature in a range from about 20 to about 100° C. to attach substituted aminomethyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing a gent added in operation (I') and to protonate a sufficient fraction of the amino nitrogen atoms in the substituted aminomethylated phenolic polymer to stabilize against settling the solution of the substituted aminomethylated phenolic polymer formed in operation; and (IV') contacting the resulting aqueous solution from the end of operation (III') with a cation exchange resin in its protonated form to remove at least about 75% of any inorganic and/or quaternary ammonium cations dissolved in said aqueous solution from the end of operation (III').

12. An acidic aqueous liquid composition according to claim 11, wherein:

there is a total concentration of "fluorometallate" anions of component (A) that is at least about 0.040 M/kg;

there is a total concentration of metal cations of component (B) that is at least about 0.054 M/kg;

there is a ratio of total concentration in M/kg of metal cations of component (B) in M/kg to the total concentration in M/kg of "fluorometallate" anions of component (A) that is in a range from about 1.00:1.00 to about 1.30:1.00;

there is a concentration of phosphorus from component (C) that is at least about 0.057 M/kg;

there is a ratio of moles of phosphorus from component (C) to moles of "fluorometallate " ions from component (A) that is in a range from about 1.00:1.00 to about 1.40:1.00;

there is a ratio of moles of phosphorus from component (C) to moles of total metal cations from component (B) that is from about 0.80:1.00 to about 1.25:1.00;

there is a concentration of moles of substituted phenol moieties from component (D) that is at least about 0.024 M/kg;

there is a ratio of moles of substituted phenol moieties from component (D) to moles of total "fluorometallate" anions from component (A) that is from about 0.40:1.00 to about 0.80:1.00;

there is a ratio of moles of substituted phenol moieties from component (D) to moles of total metal cations from component (B) that is from about 0.35:1.00 to about 0.70:1.00; and there is a ratio of moles of substituted phenol moieties from component (D) to moles of phosphorus from component (C) that is from about 0.30:1.00 to about 0.65:1.00.

13. An acidic aqueous liquid composition according to claim 1, wherein component (D) has the chemical characteristics of a polymer that is a product of reaction of:

(A') at least one precursor phenolic polymer or copolymer which does not bear any substituted aminomethyl substituents on its aromatic rings;

(B') at least one aldehyde, ketone, or mixture thereof; and (C') at least one amine.

14. An acidic aqueous liquid composition according to claim 13, wherein:

the number of moles of carbonyl groups in component (B') has a ratio to the number of moles of primary and secondary amino nitrogen atoms in component (C') that is from about 0.5:1.00 to about 1.5:1.00;

the number of moles of carbonyl groups in component (B') has a ratio to the number of moles of aromatic rings in component (A') that is from about 0.20:1.00 to about 2.00:1.00; and the number of moles of primary and secondary amino nitrogen atoms in component (C') has a ratio to the number of moles of aromatic rings in component (A') that is from about 0.20:1.00 to about 2.00:1.00.

15. An acidic aqueous liquid composition according to claim 14, wherein component (D) has been made by a process comprising the following operations:

(I') reacting the precursor phenolic polymer component (A') in water with an organic or inorganic alkalinizing agent to form an aqueous solution of the corresponding phenoxide salt;

(II') mixing the aqueous solution from operation (I') with the amine component (C') and the component (B') of aldehyde, ketone, or mixture thereof to form a single aqueous solution in which chemical reaction among components (A'), (B'), and (C') occurs at a temperature in a range from about 20 to about 100° C. to attach substituted aminomethyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing agent added in operation (I') and to protonate a sufficient fraction of the amino nitrogen atoms in the substituted aminomethylated phenolic polymer to stabilize against settling the solution of the substituted aminomethylated phenolic polymer formed in operation (II'); and (IV') contacting the resulting aqueous solution from the end of operation (III') with a cation exchange resin in its protonated form to remove at least about 75% of any inorganic and/or quaternary ammonium cations dissolved in said aqueous solution from the end of operation (III').

16. An acidic aqueous liquid composition according to claim 15, wherein:

there is a total concentration of "fluorometallate" anions of component (A) that is at least about 0.040 M/kg;

there is a total concentration of metal cations of component (B) that is at least about 0.054 M/kg;

there is a ratio of total concentration in M/kg of metal cations of component (B) in M/kg to the total concentration in M/kg of "fluorometallate" anions of component (A) that is in a range from about 1.00:1.00 to about 1.30:1.00;

there is a concentration of phosphorus from component (C) that is at least about 0.057 M/kg;

there is a ratio of moles of phosphorus from component (C) to moles of "fluorometallate " ions from component (A) that is in a range from about 1.00:1.00 to about 1.40:1.00;

there is a ratio of moles of phosphorus from component (C) to moles of total metal cations from component (B) that is from about 0.80:1.00 to about 1.25:1.00;

there is a concentration of moles of substituted phenol moieties from component (D) that is at least about 0.024 M/kg;

there is a ratio of moles of substituted phenol moieties from component (D) to moles of total "fluorometallate" anions from component (A) that is from about 0.40:1.00 to about 0.80:1.00;

there is a ratio of moles of substituted phenol moieties from component (D) to moles of total metal cations from component (B) that is from about 0.35:1.00 to about 0.70:1.00; and there is a ratio of moles of substituted phenol moieties from component (D) to moles of phosphorus from component (C) that is from about 0.30:1.00 to about 0.65:1.00.

17. An acidic aqueous liquid composition according to claim 13, when component (D) has been made by a process comprising the following operations:

(I') reacting the precursor phenolic polymer component (A') in water with an organic or inorganic alkalinizing agent to form an aqueous solution of the corresponding phenoxide salt;

(II') mixing the aqueous solution from operation (I') with the amine component (C') and the component (B') of aldehyde, ketone, or mixture thereof to form a single aqueous solution in which chemical reaction among components (A'), (B'), and (C') occurs at a temperature in a range from about 20 to about 100° C. to attach substituted aminomethyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing a gent added in operation (I') and to protonate a sufficient fraction of the amino nitrogen atoms in the substituted aminomethylated phenolic polymer to stabilize against sowing the solution of the substituted aminomethylated phenolic polymer formed in operation (II'); and (IV') contacting the resulting aqueous solution from the end of operation (III') with a cation exchange resin in its protonated form to remove at least about 75% of any inorganic and/or quatemary ammonium cations dissolved in said aqueous solution from the end of operation (III').

18. An acidic aqueous liquid composition according to claim 17, wherein:

there is a total concentration of "fluorometallate" anions of component (A) that is at least about 0.040 M/kg;

there is a total concentration of metal cations of component (B) that is at least about 0.054 M/kg;

there is a ratio of total concentration in M/kg of metal cations of component (B) in M/kg to the total concentration in M/kg of "fluorometallate" anions of component (A) that is in a range from about 1.00:1.00 to about 1.30:1.00;

there is a concentration of phosphorus from component (C) that is at least about 0.057 M/kg;

there is a ratio of moles of phosphorus from component (C) to moles of "fluorometallate" ions from component (A) that is in a range from about 1.00:1.00 to about 1.40:1.00;

there is a ratio of moles of phosphorus from component (C) to moles of total metal cations from component (B) that is from about 0.80:1.00 to about 1.25:1.00;

there is a concentration of moles of substituted phenol moieties from component (D) that is at least about 0.024 M/kg;

there is a ratio of moles of substituted phenol moieties from component (D) to moles of total "fluorometallate" anions from component (A) that is from about 0.40:1.00 to about 0.80:1.00;

there is a ratio of moles of substituted phenol moieties from component (D) to moles of total metal cations from component (B) that is from about 0.35:1.00 to about 0.70:1.00; and there is a ratio of moles of substituted phenol moieties from component (D) to moles of phosphorus from component (C) that is from about 0.30:1.00 to about 0.66:1.00.

19. An acidic aqueous liquid composition according to claim 1, wherein component (D) has been made by a process comprising the following operations:

(I') reacting a precursor phenolic polymer component (A') in water with an organic or inorganic alkalinizing a gent to form an aqueous solution of the corresponding phenoxide salt;

(II') mixing the aqueous solution from operation (I') with an amino component (C') and a component (B') of aldehyde, ketone, or mixture thereof to form a single aqueous solution in which chemical reaction among components (A'), (B'), and (C') occurs at a temperature in a range from about 20 to about 100° C. to attach substituted aminomethyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing a gent added in operation (I') and to protonate a sufficient fraction of the amino nitrogen atoms in the substituted aminomethylated phenolic polymer to stabilize against settling the solution of the substituted aminomethylated phenolic polymer formed in operation (II'); and (IV') contacting the resulting aqueous solution from the end of operation (III') with a cation exchange resin in its protonated form to remove at least about 75% of any inorganic and/or quaternary ammonium cations dissolved in said aqueous solution from the end of operation (III').

20. An acidic aqueous liquid composition according to claim 19, wherein:

there is a total concentration of "fluorometallate" anions of component (A) that is at least about 0.040 M/kg;

there is a total concentration of metal cations of component (B) that is at least about 0.054 M/kg;

there is a ratio of total concentration in M/kg of metal cations of component (B) in M/kg to the total concentration in M/kg of "fluorometallate" anions of component (A) that is in a range from about 1.00:1.00 to about 1.30:1.00;

there is a concentration of phosphors from component (C) that is at least about 0.057 M/kg;

there is a ratio of moles of phosphorus from component (C) to moles of "fluorometallate" ions from component (A) that is in a range from about 1.00:1.00 to about 1.40:1.00;

there is a ratio of mols of phosphorus from component (C) to moles of total metal cations from component (B) that is from about 0.80:1.00 to about 1.25:1.00;

there is a concentration of moles of substituted phenol moieties from component (D) that is at least about 0.024 M/kg;

there is a ratio of moles of substituted phenol moieties from component (D) to moles of total "fluorometallate" anions from component that is from about 0.40:1.00 to about 0.80:1.00;

there is a ratio of moles of substituted phenol moieties from component (D) to moles of total metal cations from component (B) that is from about 0.35:1.00 to about 0.70;1.00; and there is a ratio of moles of substituted phenol moieties from component (D) to moles of phosphorus from component (C) that is from about 0.30:1.00 to about 0.65:1.00.

21. An acidic aqueous liquid composition according to claim 1, wherein:

there is a total concentration of "fluorometallate" anions of component (A) that is at least about 0.040 M/kg;

there is a total concentration of metal cations of component (B) that is at least about 0.054 M/kg;

there is a ratio of total concentration in M/kg of metal cations of component (B) in M/kg to the total concentration in M/kg of "fluorometallate" anions of component (A) that is in a range from about 1.00:1.00 to about 1.30:1.00;

there is a concentration of phosphorus from component (C) that is at least about 0.057 M/kg;

there is a ratio of moles of phosphorus from component (C) to moles of "fluorometallate" ions from component (A) that is in a range from about 1.00:1.00 to about 1.40:1.00;

there is a ratio of moles of phosphorus from component (C) to moles of total metal cations from component (B) that is from about 0.80:1.00 to about 1.25:1.00;

there is a concentration of moles of substituted phenol moieties from component (D) that is at least about 0.024 M/kg;

there is a ratio of moles of substituted phenol moieties from component (D) to moles of total "fluorometallate " anions from component (A) that is from about 0.40:1.00 to about 0.80:1.00;

there is a ratio of moles of substituted phenol moieties from component (D) to moles of total metal cations from component (B) that is from about 0.35:1.00 to about 0.70:1.00; and there is a ratio of moles of substituted phenol moieties from component (D) to moles of phosphorus from component (C) that is from about 0.30:1.00 to about 0.65:1.00.

22. An acidic aqueous liquid composition that is suitable for use directly, after being diluted with water, or both directly and after being diluted with water, for generating a corrosion reducing coating over a metal surface when contacted therewith, said composition having been made by mixing with water at least the following components:

(A) a source of a component of "fluorometallate" anions, ach of said anions consisting of (i) at least four fluorine atoms, (ii) at least one atom of an element select d from the group consisting of titanium, zirconium, hafnium, scion, aluminum, and boron, and, optionally, one or both of (iii) ionizable hydrogen atoms, and (iv) one or more oxygen atoms;

(B) a source of a component of divalent or tetravalent cations of elements selected from the group consisting of cobalt, magnesium, manganese, zinc, nickel, tin, copper, zirconium, iron, and strontium;

(C) a source of a component selected from the group consisting of phosphorus-containing inorganic oxyanions and phosphonate anions; and (D) a source of a component of water-soluble, water-dispersible, or both water-soluble and water-dispersible polymers of hydroxy styrene, modified by substitution on the aromatic rings of the polymers of at least mono-substituted aminomethyl moieties, in which the substituents (other than the carbon atom that is directly bonded to an aromatic ring in the polymer) on the amino nitrogen atom jointly contain at least two carbon atoms and at least one hydroxy moiety but neither of these substituents individually contains more than half as many hydroxyl moieties as it has carbon atoms, unless it contains only one carbon atom.

23. An acidic aqueous liquid composition according to claim 22, wherein:

the source of "fluorometallate" anions provides such anions in an amount corresponding to a concentration in the acidic aqueous liquid composition that is at least about 0.010 M/kg;

the source of metal cations of component (B) provides such cations in an amount corresponding to a concentration in the acidic aqueous liquid composition that is at least about 0.020 M/kg;

there is a ratio of moles of metal cations of component (B) supplied to the acidic aqueous liquid composition to moles of "fluorometallate" anions supplied to the acidic aqueous liquid composition that is in a range from about 0.4:1.0 to about 1.6:1.00;

the source of phosphorus for component (C) provides phosphorus in an amount corresponding to a concentration in an acidic aqueous liquid composition that is at least about 0.017 M/kg;

there is a ratio of moles of phosphorus from component (C) supplied to the acidic aqueous liquid composition to moles of "fluorometallate" ions from component (A) supplied to the acidic aqueous liquid composition that is in a range from about 0.60:1.00 to about 2.6:1.00;

there is a ratio of moles of phosphorus from component (C) supplied to the acidic aqueous liquid composition to moles of total metal cations from component (B) supplied to the acidic aqueous liquid composition that is from about 0.4:1.0 to about 2.2:1.00;

the source of substituted phenol moieties for component (D) provides such moieties in an amount corresponding to a concentration in the acidic aqueous liquid composition that is at least about 0.008 M/kg;

there is a ratio of moles of substituted phenol moieties for component (D) supplied to the acidic aqueous liquid composition to moles of total "fluorometallate" anions from component (A) supplied to the acidic aqueous liquid composition that is from about 0.12:1.00 to about 1.5:1.00;

there is a ratio of moles of substituted phenol moieties from component (D) supplied to the acidic aqueous liquid composition to moles of total metal cations from component (B) supplied to the acidic aqueous liquid composition that is from about 0.12:1.00 to about 1.5:1.00; and there is a ratio of moles of substituted phenol moieties from component (D) supplied to the acidic aqueous liquid composition to moles of phosphorus from component (C) that is from about 0.12:1.00 to about 1.5:1.00.

24. An acidic aqueous liquid composition according to claim 23, wherein:

component (A) is selected from the group consisting of fluorotitanate and fluorozirconate;

at least 60% of component is selected from the group consisting of divalent manganese, cobalt, nickel, and magnesium; and there is not more than 0.10% of organic materials that are liquid at 25° C. under normal atmospheric pressure and have a vapor pressure of at least 0.05 bar at 25° C.

25. An acidic aqueous liquid composition according to calm 24, wherein component (D) has the chemical characteristics of a polymer that is a product of reaction of:

(A') at least one precursor phenolic polymer or copolymer which does not bear any substituted aminomethyl substituents on its aromatic rings;

(B') at least one aldehyde, ketone, or mixture thereof; and (C') at least one amine.

26. An acidic aqueous liquid composition according to claim 25, wherein:

the number of moles of carbonyl groups in component (B') has a ratio to the number of moles of primary and secondary amino nitrogen atoms in component (C') that is from about 0.5:1.00 to about 1.5:1.00;

the number of moles of carbonyl groups in component (B') has a ratio to the number of moles of aromatic rings in component (A') that is from about 0.20:1.00 to about 2.00:1.00; and the number of moles of primary and secondary amino nitrogen atoms in component (C') has a ratio to the number of moles of aromatic rings in component (A') that is from about 0.20:1.00 to about 2.00:1.00.

27. An acidic aqueous liquid composition according to claim 26, wherein component (D) has been made by a process comprising the following operations:

(I') reacting the precursor phenolic polymer component (A') in water with an organic or inorganic alkalinizing agent to form an aqueous solution of the corresponding phenoxide salt;

(II') mixing the aqueous solution from operation (I') with the amine component (C') and the component (B') of aldehyde, ketone, or mixture thereof to form a single aqueous solution in which chemical reaction among components (A'), (B'), and (C') occurs at a temperature in a range from about 20 to about 100° C. to attach substituted amino methyl moieties to at least some of the aromatic rings in the precursor polymer and produce an aqueous solution of substituted aminomethylated phenolic polymer molecules;

(III') adding at least one acid to the aqueous solution formed at the end of operation (II'), the quantity of acid added being sufficient to neutralize the alkalinizing agent added in operation (I') and to protonate a sufficient fraction of the amino nitrogen atoms in the substituted aminomethylated phenolic polymer to stabilize against settling the solution of the substituted aminomethylated phenolic polymer formed in operation (II'); and (IV') contacting the resulting aqueous solution from the end of operation (III') with a cation exchange resin in its protonated form to remove at least about 75% of any inorganic and/or quaternary ammonium cations dissolved in said aqueous solution from the end of operation (III').

28. An acidic aqueous liquid composition according to claim 27, wherein:

the source of "fluorometallate" anions of component (A) provides such anions in an amount corresponding to a concentration in the acidic aqueous liquid composition that is at least about 0.040 M/kg;

the source of metal cations of component (B) provides such cations in an amount corresponding to a concentration in the acidic aqueous liquid composition that is at least about 0.054 M/kg;

there is a ratio of moles of metal cations of component (B) supplied to the acidic aqueous liquid composition to the ratio of moles of "fluorometallate" anions supplied to the acidic aqueous liquid composition that is in a range from about 1.00:1.00 to about 1.30:1.00;

the source of phosphorus for component (C) provides phosphorus in an amount corresponding to a concentration in the acidic aqueous liquid composition that is at least about 0.057 M/kg;

there is a ratio of moles of phosphorus from component (C) supplied to the acidic aqueous liquid composition to moles of "fluorometallate" ions from component (A) supplied to the acidic aqueous liquid composition that is in a range from about 1.00:1.00 to about 1.40:1.00;

there is a ratio of moles of phosphorus from component (C) supplied to the acidic aqueous liquid composition to moles of total metal cations from component (B) supplied to the acidic aqueous liquid composition that is from about 0.80:1.00 to about 1.25:1.00;

the source of substituted phenol moieties from component (D) provides such moieties in an amount corresponding to a concentration in the acidic aqueous liquid composition that is at least about 0.024 M/kg;

there is a ratio of moles of substituted phenol moieties from component (D) supplied to the acidic aqueous liquid composition to moles of total "fluorometallate" anions from component (A) supplied to the acidic aqueous liquid composition that is from about 0.40:1.00 to about 0.80:1.00;

there is a ratio of moles of substituted phenol moieties from component (D) supplied to the acidic aqueous liquid composition to moles of total metal cations from component (B) supplied to the acidic aqueous liquid composition that is from about 0.35:1.00 to about 0.70:1.00; and there is a ratio of moles of substituted phenol moieties from component (D) supplied to the acidic aqueous liquid composition to moles of phosphorus from component (C) supplied to the acidic aqueous liquid composition that is from about 0.30:1.00 to about 0.65:1.00.

29. A process of forming a corrosion reducing coating over a metal surface, said process comprising contacting the metal surface with an acidic aqueous liquid composition according to claim 1.

30. A process according to claim 29 that produces a dried add-on mass of coating per unit area of surface coated that is from about 50 to about 300 mg/m$^2$.

31. The process of claim 29 wherein said metal surface is cold rolled steel.

32. The process of claim 29 comprising an additional step of drying the acidic aqueous liquid composition.

33. The process of claim 32 comprising an additional step of applying an organic protective coating over the metal surface having a dried coating of the acidic aqueous liquid composition thereon.

34. A process of forming a corrosion reducing coating over a metal surface, said process comprising contacting the metal surface with an acidic aqueous liquid composition according to claim 8.

35. A process of forming a corrosion reducing coating over a metal surface, said process comprising contacting the metal surface with an acidic aqueous liquid composition according to claim 13.

36. A process of forming a corrosion reducing coating over a metal surface, said process comprising contacting the metal surface with an acidic aqueous liquid composition according to claim 19.

37. A process of forming a corrosion reducing coating over a metal surface, said process comprising contacting the metal surface with an acidic aqueous liquid composition according to claim 21.

38. A process of forming a corrosion reducing coating over a metal surface, said process comprising contacting the metal surface with an acidic aqueous liquid composition according to claim 22.

* * * * *

UNITED STATES PATENT AND TRADEMARK OFFICE

CERTIFICATE OF CORRECTION

PATENT NO. : 6,758,916 B1
APPLICATION NO. : 10/111177
DATED : July 6, 2004
INVENTOR(S) : McCormick It is certified that error appears in the above-identified patent and that said Letters Patent is hereby corrected as shown below:

Column 16, line 1, delete “fin” and insert therefor --tin--.

Column 18, line 59, delete “a gent” and insert therefor --agent--.

Column 19, line 6, delete “a” and in line 7, delete “gent” and insert therefor --agent--.

Column 21, line 14, delete “when” and insert therefor --wherein--.

Column 21, line 32, delete “a” and in line 33, delete “gent” and insert therefor --agent--.

Column 21, line 36, delete “sowing” and insert therefor --settling--.

Column 21, line 41, delete “quatemary” and insert therefor --quaternary--.

Column 22, line 17, delete “a gent” and insert therefor --agent--.

Column 22, line 33, delete “a” and in line 34, delete “gent” and insert therefor --agent--.

Column 22, line 56, delete “phosphors” and insert therefor --phosphorus--.

Column 22, line 62, delete “mols” and insert therefor --moles--.

Column 23, line 3, after “component” insert --(A)--.

Column 23, line 55, delete “ach” and insert therefor --each--.

Column 23, line 56, delete “select d” and insert therefor --selected--.

Column 23, line 58, delete “scion” and insert therefor --silicon--.

UNITED STATES PATENT AND TRADEMARK OFFICE

CERTIFICATE OF CORRECTION

PATENT NO. : 6,758,916 B1
APPLICATION NO. : 10/111177
DATED : July 6, 2004
INVENTOR(S) : McCormick It is certified that error appears in the above-identified patent and that said Letters Patent is hereby corrected as shown below:

Column 25, line 8, delete “calm” and insert therefor --claim--.

Signed and Sealed this

Twenty-second Day of August, 2006

JON W. DUDAS
*Director of the United States Patent and Trademark Office*